US009512812B2

(12) United States Patent
Odahara et al.

(10) Patent No.: US 9,512,812 B2
(45) Date of Patent: Dec. 6, 2016

(54) ENGINE STARTING DEVICE

(75) Inventors: Kazuhiro Odahara, Chiyoda-ku (JP); Koichiro Kamei, Chiyoda-ku (JP); Daisuke Mizuno, Chiyoda-ku (JP); Masami Abe, Chiyoda-ku (JP); Naohito Kaneda, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 71 days.

(21) Appl. No.: 13/977,848

(22) PCT Filed: Mar. 31, 2011

(86) PCT No.: PCT/JP2011/058209

§ 371 (c)(1),
(2), (4) Date: Jul. 1, 2013

(87) PCT Pub. No.: WO2012/131973

PCT Pub. Date: Oct. 4, 2012

(65) Prior Publication Data

US 2013/0291680 A1 Nov. 7, 2013

(51) Int. Cl.
*F02N 11/02* (2006.01)
*F02N 11/08* (2006.01)
(Continued)

(52) U.S. Cl.
CPC ..... *F02N 11/02* (2013.01); *F02N 15/062* (2013.01); *F02N 15/063* (2013.01); *F02N 11/00* (2013.01);
(Continued)

(58) Field of Classification Search
CPC .... F02N 11/00; F02N 11/0851; F02N 15/063; F02N 15/06; F02N 15/061; F02N 15/062
(Continued)

(56) References Cited

U.S. PATENT DOCUMENTS 1,348,288 A 8/1920 McGrath
4,184,378 A * 1/1980 Mazzorana ..... 74/7 A
(Continued)

FOREIGN PATENT DOCUMENTS

DE 102009026593 A1 12/2010
EP 2650529 A1 10/2013
(Continued)

OTHER PUBLICATIONS

Office Action issued Dec. 10, 2013 in Japanese Patent Application No. 2013-506981.
(Continued)

*Primary Examiner* — William Kelleher
*Assistant Examiner* — Gregory Prather
(74) *Attorney, Agent, or Firm* — Sughrue Mion, PLLC; Richard C Turner

(57) ABSTRACT

It is possible to obtain an engine starting device in which, at the time of initial engagement of a first pinion gear and an engine starting gear, in a case where the first pinion gear collides with the engine starting gear, the first pinion gear is inclined with respect to the second pinion gear, a void having a predetermined size for expanding the inclined state is formed between a surface of an end surface portion of the first pinion gear on the side of an end surface portion of the second pinion gear, and a surface of an end surface portion of the second pinion gear on the side of the end surface portion of the first pinion gear, even in a case where any one of the rotation speed of the engine starting gear and the rotation speed of the pinion gear is larger than the other, rotation synchronization of the engine starting gear and the pinion gear and phase focusing of the teeth between the engine starting gear and the pinion gear is further rapidly and further reliably performed at the time when the engine starting gear and the pinion gear is abutted to each other,
(Continued)

noise is decreased, and shortening of the life due to abrasion can be suppressed.

14 Claims, 10 Drawing Sheets

(51) Int. Cl.
*F02N 15/06* (2006.01)
*F02N 11/00* (2006.01)
*F02N 15/02* (2006.01)
*F02N 15/04* (2006.01)

(52) U.S. Cl.
CPC ..... *F02N 11/0851* (2013.01); *F02N 15/023* (2013.01); *F02N 15/046* (2013.01); *F02N 15/065* (2013.01); *F02N 15/067* (2013.01); *Y10T 74/132* (2015.01)

(58) Field of Classification Search
USPC ..... 74/6, 7 A, 7 C, 7 R, 123, 124, 406, 410,74/411
See application file for complete search history.

(56) References Cited

U.S. PATENT DOCUMENTS 4,737,654 A * 4/1988 Morishita et al. ..... 290/48
4,916,958 A * 4/1990 Okamoto et al. ..... 74/6
5,012,686 A * 5/1991 Morishita et al. ..... 74/7 A
5,197,342 A * 3/1993 Nakagawa ..... 74/7 A
5,237,882 A * 8/1993 Giometti ..... 74/7 A
5,331,860 A * 7/1994 Demoule et al. ..... 74/7 R
5,370,009 A * 12/1994 Isozumi ..... 74/7 C
5,540,110 A * 7/1996 Zenmei et al. ..... 74/7 A
5,600,184 A * 2/1997 Shiga et al. ..... 290/38 R
6,268,670 B1 * 7/2001 Kuragaki et al. ..... 310/75 R
8,869,640 B2 * 10/2014 Abe et al. ..... 74/7 A
2004/0177710 A1 * 9/2004 Kajino et al. ..... 74/7 A
2008/0289446 A1 * 11/2008 Kamei et al. ..... 74/7 R
2009/0151684 A1 * 6/2009 Gast et al. ..... 123/185.8
2010/0033066 A1 2/2010 Murata et al.
2013/0233128 A1 9/2013 Mizuno et al.

FOREIGN PATENT DOCUMENTS

JP 58-193145 U 12/1983
JP 2001-248710 A 9/2001
JP 2006-161590 A 6/2006
JP 2009-24665 A 2/2009
JP 2009-168230 A 7/2009
JP 2010-144554 A 7/2010
WO 2010069645 A1 6/2010
WO 2010136429 A1 12/2010
WO 2011138905 A1 11/2011

OTHER PUBLICATIONS

Communication dated Jul. 29, 2014, Issued by the European Patent Office in counterpart Application No. 11862499.8.
Communication dated Sep. 19, 2014, issued by the Korean Intellectual Property Office in counterpart Application No. 10-2013-7026682.
Communication dated Jul. 3, 2015 from the State Intellectual Property Office of the People's Republic of China in counterpart application No. 201180069748.1.

* cited by examiner

ENGINE STARTING DEVICE

CROSS REFERENCE TO RELATED APPLICATIONS

This application is a National Stage of International Application No. PCT/JP2011/058209, filed on Mar. 31, 2011, the contents of all of which are incorporated herein by reference in their entirety.

TECHNICAL FIELD

The invention relates to an engine starting device including: a motor unit; a pinion gear unit which rotates according to rotation of an output rotation shaft driven by the motor unit; a pushing mechanism which moves the pinion gear unit towards an engagement location of a pinion gear and an engine starting gear; in which an engine is started by a rotation force of the motor unit through the pinion gear and the engine starting gear which are engaged with each other, and particularly to the pinion gear unit.

BACKGROUND ART

There has been known a device disclosed in Patent Citation 1 as an engine starting device (hereinafter referred to as a starter) of a vehicle or the like. The starter is configured with a motor which generates a rotation force, a pinion gear which is disposed to be rotatable on an output shaft of the motor and to be movable in an axial direction, an electromagnetic switch which turns on and off the power of the motor, and the like. If the electromagnetic switch is operated (an electromagnetic force is generated to attract a plunger), the pinion gear is moved in the axial direction to be engaged with an engine starting gear such as a ring gear or the like of an engine (hereinafter, referred to as a "ring gear"), and thus, the ring gear is rotated and the engine is started.

In addition, at the time of the movement of the pinion gear in the axial direction, in a case where the teeth of the pinion gear collide with a side surface of the ring gear and cannot be engaged therewith, a reactive force is saved in a spring mounted in the electromagnet switch before closing a main contact of the motor. After that, if the main contact is closed to turn on the motor, the pinion gear is forcibly rotated with the rotation force of the motor, and at the time of rotation to a location where the engagement with the ring gear can be performed, the pinion gear is pressed in the axial direction by the reactive force saved in the spring to be engaged with the ring gear.

In a vehicle for improving recent environmental concerns, for objects of improvement of fuel efficiency and improvement of discharge emission, an idling stop system which controls automatic stop and restarting of the engine is gradually employed, and the number of usage of the starter tends to be increased. In addition, by assuming a case of receiving a restarting request at the time of a state where the engine rotation is not completely stopped in idling stop, a functional improvement is designed by engaging the pinion gear with the ring gear in the rotation of the ring gear to perform restarting. Accordingly, it is difficult to secure sufficient engagement durability in the starter of the related art.

There is known a method of processing a chamfering shape of the pinion gear in such a case, to prevent abrasion of the end surface of the tooth and to improve durability of a gear device without degrading the engagement property (for example, see Patent Citation 1). In addition, there is known a method of improving the engagement property by further processing the shape of the pinion gear (for example, see Patent Citation 2). Further, there is known a method of improving the durability by processing a structure of the pinion gear portion (for example, see Patent Citation 3).

[Patent Citation 1] JP-A-2001-248710 (Abstract, FIG. 3 and the description thereof)

[Patent Citation 2] JP-A-2009-168230 (Abstract, FIG. 1 and the description thereof)

[Patent Citation 3] JP-A-2006-161590 (Abstract, FIG. 2 and the description thereof)

DISCLOSURE OF INVENTION

Technical Problem

As disclosed in Patent Citation 1, for realizing easy engagement of the pinion gear and the ring gear, the processing of the shape of the tip of the pinion gear to provide chamfered surface or the like on the tip of the tooth is considered. Accordingly, in Patent Citation 1, insertion in the space provided by the chamfering can be performed and an attracting effect by surface abutting is exhibited.

Here, the attracting effect by chamfering is exhibited as long as the engagement is performed in a state where the ring gear is stopped. However, in a case where the relative rotation speed of the pinion is different in the rotation of the ring gear, since both gears collide with each other due to abutting of the chamfered portion, a force component which pushes the pinion gear back to the axial direction is generated. Accordingly, there was a problem of generation of collision noise at the time of the engagement or delay of the engagement.

On the other hand, as disclosed in Patent Citation 2, a process of the shape of the tip of the pinion gear to provide alternate level differences, to perform rapid engagement is considered. Accordingly, in Patent Citation 2, an effect of making insertion in the space provided by the level differences possible is exhibited.

Herein, when two teeth of the pinion gear are abutted with the ring gear for the engagement, engagement failure due to a riding-on phenomenon can be avoided, however, there is a problem that the rotation force of the starter motor cannot be transmitted properly by buffering of the tips of the teeth, depending on a location relationship of the pinion gear and the ring gear.

In addition, as disclosed in Patent Citation 3, in the engagement of the pinion gear and the ring gear, it is considered to process of the structure of the pinion gear unit. Accordingly, in Patent Citation 3, a twist angle between a pinion stroke and a helical spline coupling portion is set so that the pinion gear can be rotated to the location where the engagement with the ring gear can be performed before the motor contact is closed, after the pinion gear which is pushed to a direction opposite to the motor is abutted to the end surface of the ring gear.

Herein, the effect thereof is exhibited as long as the engagement is performed in a state where the ring gear is stopped. However, in a case where the relative rotation speed of the pinion gear is different in the rotation of the ring gear, the effect is not exhibited, in some cases. Accordingly, there is a problem of generation of collision noise at the time of the engagement or delay of the engagement.

As described above, in a case of engaging the pinion gear in the rotation of the ring gear, if further reliable rotation synchronization and phase focusing are not performed at the time of abutting, then the noise, the shortening of life due to abrasion, and the delay of starting due to loss of the engagement time may occur.

The present invention has been made to address the aforementioned problems and aims at obtaining an engine starting device which further rapidly and further reliably performs rotation synchronization of the engine starting gear and the pinion gear and phase focusing of the teeth between the engine starting gear and the pinion gear at the time when the engine starting gear is abutted to the pinion gear, even in a case where any one of the rotation speed of the engine starting gear and the rotation speed of the pinion gear is great, when the pinion gear is engaged with the engine starting gear in the rotation of the engine starting gear such as a ring gear, and which can suppress the noise and shortening of the life due to the abrasion.

Technical Solution

An engine starting device according to the present invention including: a motor unit; a pinion gear unit which rotates according to the rotation of an output rotation shaft driven by the motor unit; and a pushing mechanism which moves the pinion gear unit towards an engagement location of the pinion gears, and an engine starting gear, in which an engine is started by a rotation force of the motor unit through the pinion gears, and the engine starting gear which are engaged with each other, the pinion gear unit includes a first pinion gear which is initially engaged with the engine starting gear if the pinion gear unit is moved towards the engagement location by the pushing mechanism, and a second pinion gear which is engaged with the engine starting gear later than the first pinion gear, in a state where the first pinion gear is engaged with the engine starting gear, if the pinion gear unit further moves towards the engagement location by the pushing mechanism, to be adjacent to each other, and a void is formed between a surface of an a tooth portion of the first pinion gear on the side of a tooth portion of the second pinion gear, and a surface of a tooth portion of the second pinion gear on the side of a tooth portion of the first pinion gear.

Advantageous Effects

According to the engine starting device according to the present invention, since a structure including a first pinion gear which is initially engaged with the engine starting gear if the pinion gear unit is moved towards the engagement location by the pushing mechanism, and a second pinion gear which is engaged with the engine starting gear later than the first pinion gear, in a state where the first pinion gear is engaged with the engine starting gear, if the pinion gear unit further moves towards the engagement location by the pushing mechanism, to be adjacent to each other, and a void is formed between a surface of a tooth portion of the first pinion gear on the side of a tooth portion of the second pinion gear, and a surface of an a tooth portion of the second pinion gear on the side of the a tooth portion of the first pinion gear, and since the inclination of the first pinion gear is expanded, a region where a tooth surface of the engine starting gear and a tooth surface of the first pinion gear is increased, and an inserting property of the first pinion gear to the engine starting gear is improved, at the time of the engagement of the pinion gears and the engine starting gear in the rotation of the engine starting gear, it is possible to obtain an engine starting device which further rapidly and further reliably performs rotation synchronization of the engine starting gear and the pinion gear and the phase focusing of the teeth between the engine starting gear and the pinion gear at the time when the engine starting gear is abutted to the pinion gear, even in a case where any one of the rotation speed of the engine starting gear and the rotation speed of the pinion gear is great, and which can decrease the noise and suppress shortening of the life due to the abrasion.

BEST MODE FOR CARRYING OUT THE INVENTION

Hereinafter, preferred Embodiments of an engine starting device of the present invention will be described with reference to the drawings.

Embodiment 1

Figure 1:
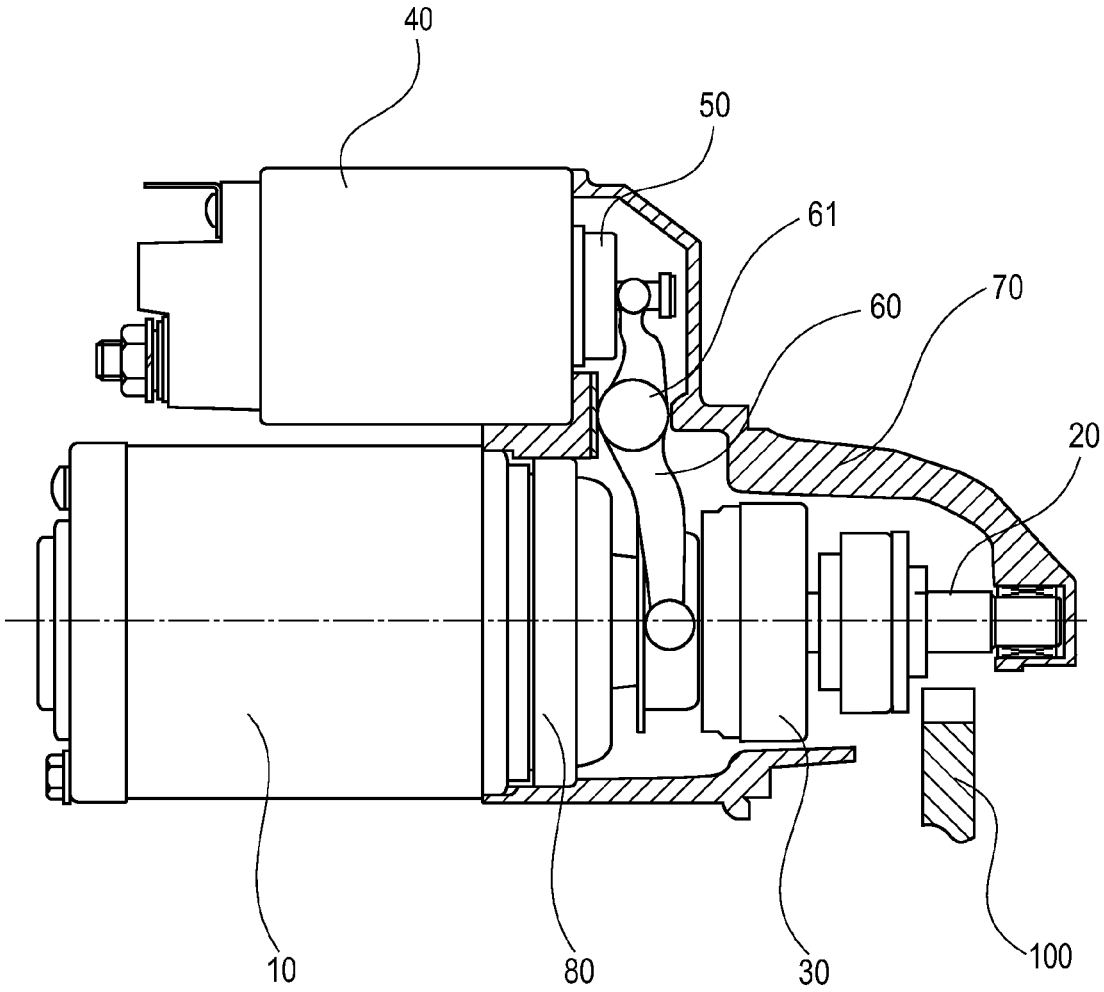
FIG. 1 is a view showing Embodiment 1 of the invention and is a front longitudinal sectional view showing an example of an engine starting device.
Figure 2:
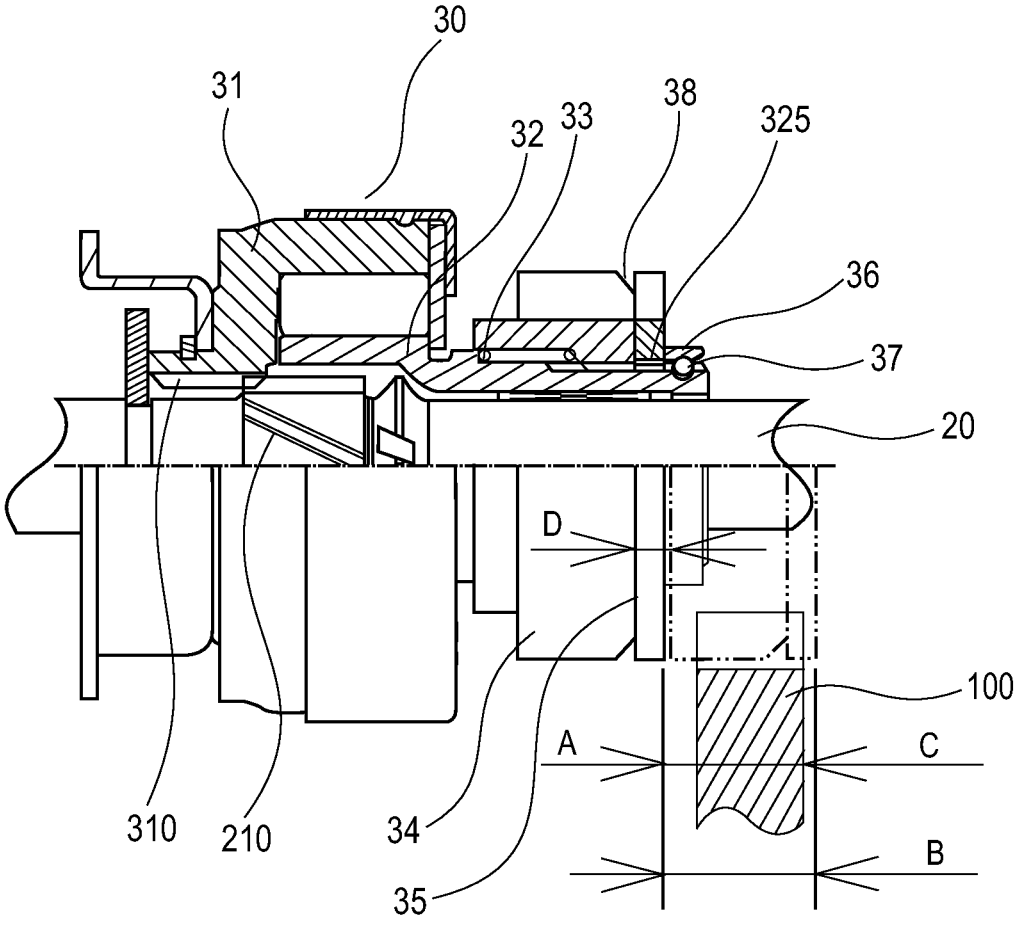
FIG. 2 is a view showing Embodiment 1 of the invention and is a front longitudinal sectional view showing an example of a pinion gear unit.
Figure 3:
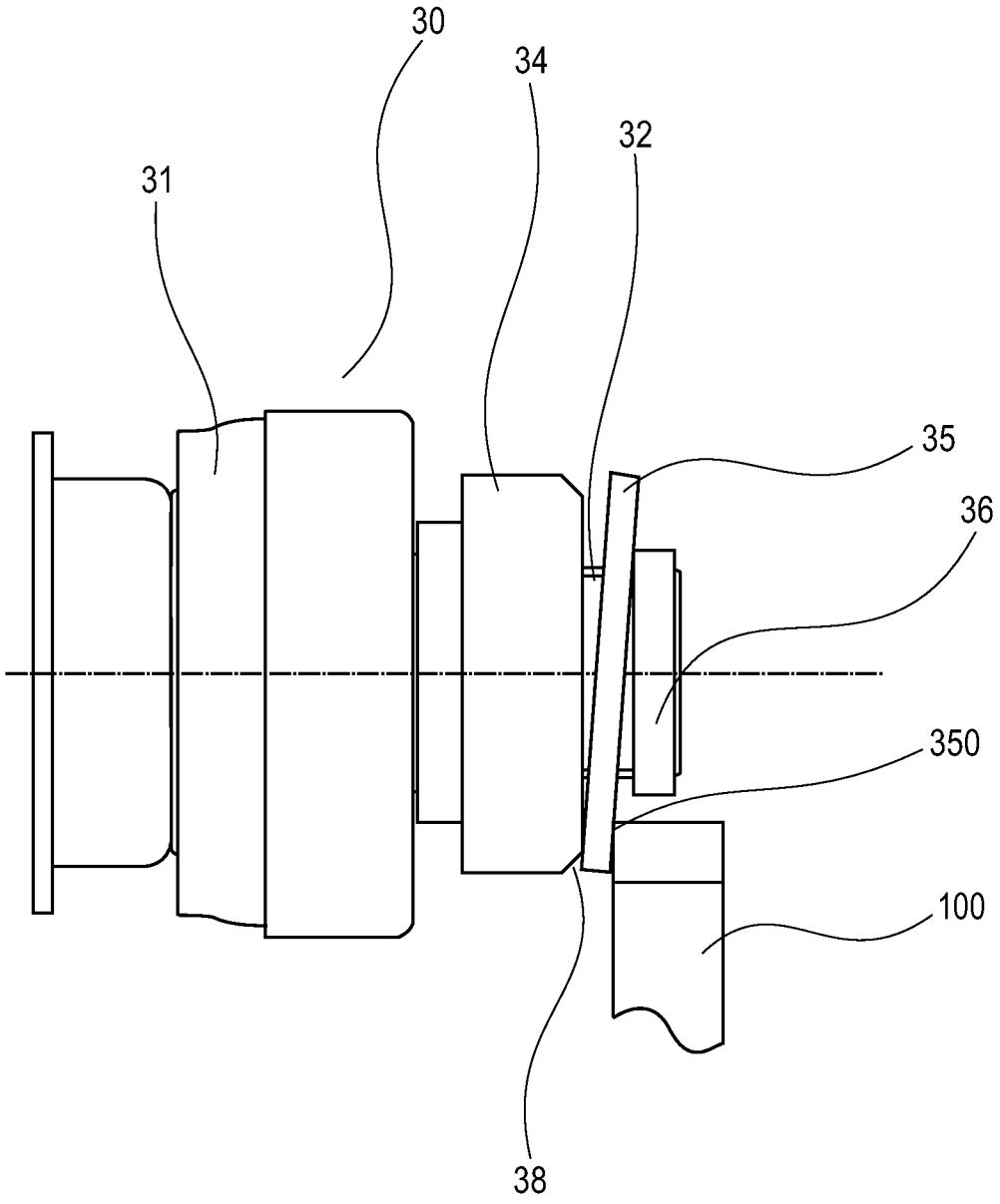
FIG. 3 is a view showing Embodiment 1 of the invention and is a front view showing an example of a pinion gear unit in a state where a first pinion gear and a ring gear collide with each other and the first pinion gear is inclined.
Figure 4:
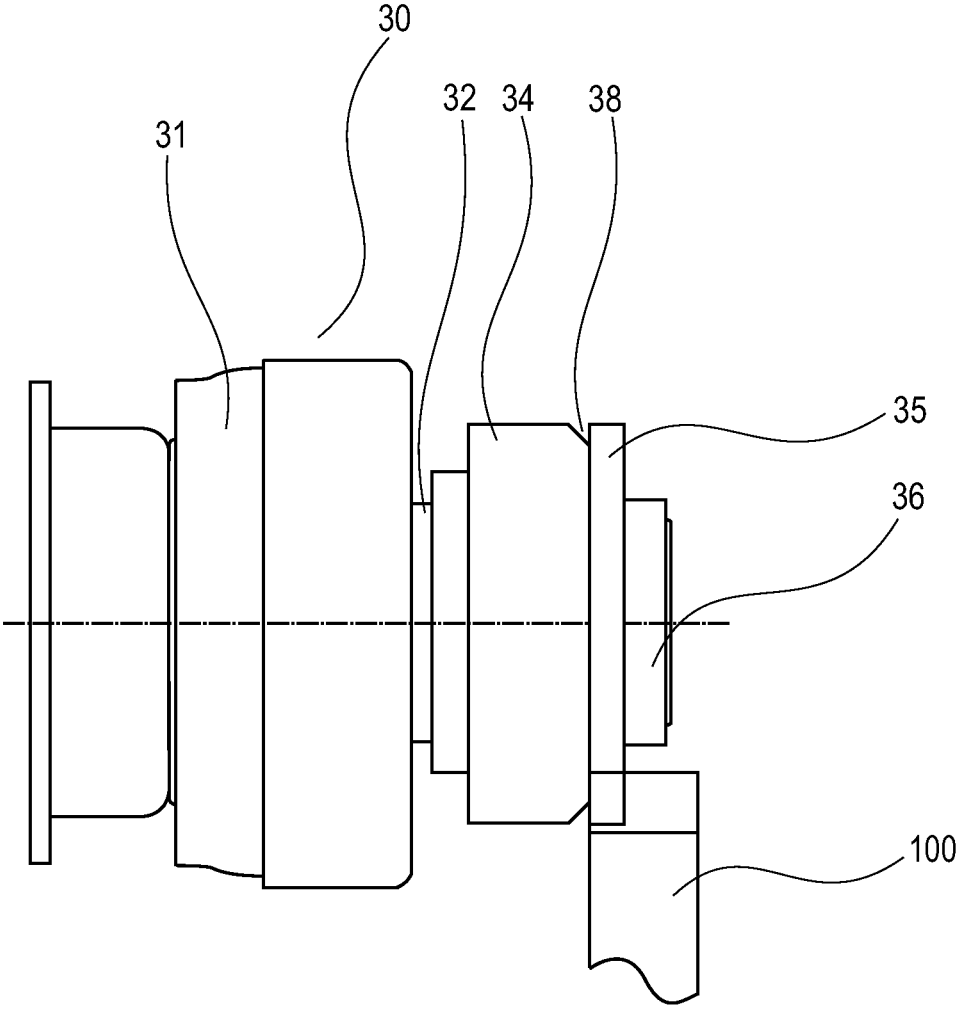
FIG. 4 is a view showing Embodiment 1 of the invention and is a front view showing an example of a pinion gear unit in a state where, after the state of FIG. 3, the ring gear is inserted to the first pinion gear to be abutted to the second pinion gear.
Figure 5:
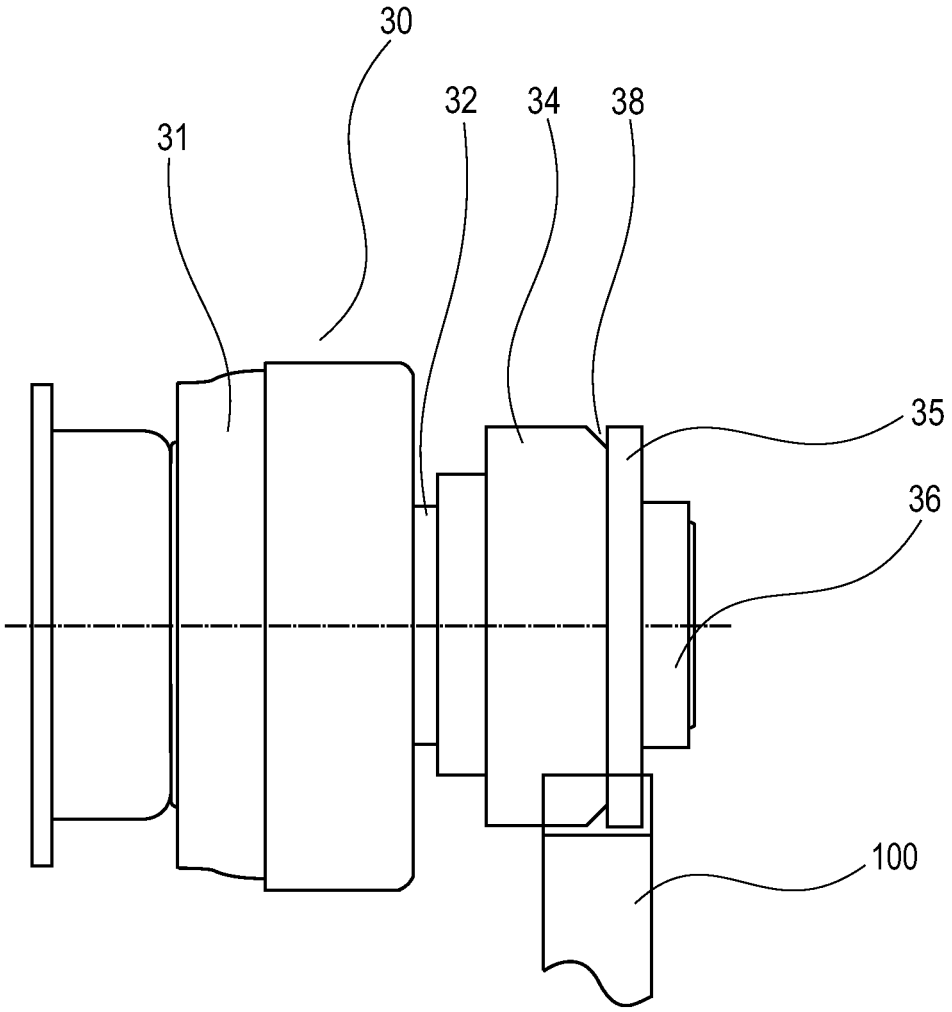
FIG. 5 is a view showing Embodiment 1 of the invention and is a front view showing an example of a pinion gear unit in a state where, after the state of FIGS. 3 and 4, the first pinion gear and the second pinion gear is inserted to the ring gear to be engaged.

Hereinafter, Embodiment 1 of the invention will be described with reference to FIGS. 1 to 5. FIG. 1 is a front longitudinal sectional view showing an example of an engine starting device, FIG. 2 is a front longitudinal sectional view showing an example of a pinion gear unit, FIG. 3 is a front view showing an example of a pinion gear unit in a state where a first pinion gear and a ring gear collide with each other and the first pinion gear is inclined, FIG. 4 is a front view showing an example of a pinion gear unit in a state where, after the state of FIG. 3, the ring gear is inserted to the first pinion gear to be abutted to the second pinion gear, and FIG. 5 is a front view showing an example of a pinion gear unit in a state where, after the state of FIGS. 3 and 4, the first pinion gear and the second pinion gear are inserted to the ring gear to be engaged.

The engine starting device of Embodiment 1 shown in FIG. 1 is configured with a motor unit 10, an output rotation shaft 20, a pinion gear unit 30, a switch unit 40, a plunger 50, a pushing mechanism such as a lever (hereinafter, referred to as a "lever") 60, a bracket 70, and a decelerating gear unit 80.

The motor unit 10 generates a rotation force by being turned on, and transmits the rotation force to an engine (not shown) and thus the engine is started. The output rotation shaft 20 is coupled with the output shaft side of the motor through the decelerating gear unit 80. As shown in FIG. 2, the pinion gear unit 30 is engaged with a helical spline 210 formed on the output rotation shaft 20 by a helical spline 310 formed on an over-running clutch (one-direction clutch) 31, is integrated with the over-running clutch 31, and can slide on the output rotation shaft 20 in the axial direction of the output rotation shaft 20 (extending direction of the output rotation shaft 20).

Since the switch unit 40 turns on the power to the coil (not shown), the plunger 50 is attracted by the electromagnetic force generated on the coil. The lever 60 transmits the movement of the plunger 50 due to the attraction, to the pinion gear unit 30. The bracket 70 holds the components (the motor unit 10, the output rotation shaft 20, the pinion gear unit 30, the switch unit 40, the plunger 50, the lever 60, and the decelerating gear unit 80) to fix them on the side of the engine (not shown).

As shown in FIG. 2, the pinion gear unit 30 is configured with the over-running clutch 31 which is a one-direction clutch, a cylindrical rotation member 32, a center portion of which is penetrated by the output rotation shaft 20, an elastic body 33 such as a compression spring or the like, a second pinion gear 34, a first pinion gear 35, a stopper 36, and a ring 37 which fixes the stopper 36 to an outer periphery of the tip of the cylindrical rotation member 32. In addition, in the abutted portion of the first pinion gear 35 and the second pinion gear 34, a void 38 is formed on the outer periphery end portion of the second pinion gear 34. As shown in the drawing, a symbol A in the drawing represents a facing gap between the first pinion gear 35 and an engine starting gear such as a ring gear (hereinafter, referred to as a "ring gear") 100 at the time of rest of the starter, a symbol B represents a movement amount of the pinion gear unit, a symbol C represents a thickness of the ring gear 100 in the axial direction, and a symbol D represents a thickness of the first pinion gear 35 in the axial direction, respectively.

Herein, the first pinion gear 35 performs a surface hardening process using a ferrous material. The surface hardness of the second pinion gear 34, the first pinion gear 35, and the ring gear 100 is set to satisfy ring gear<first pinion gear≤second pinion gear, and an effective case depth of the first pinion gear 35 is set to satisfy effective case depth of the first pinion gear≤D/2, of the thickness D of the first pinion gear 35.

Further, the thickness D of the first pinion gear 35 is configured in a range of B−(A+C)<thickness D of first pinion gear 35<B−(A+C)/2.

FIG. 3 is a front view showing an example of the pinion gear unit in a state where the first pinion gear 35 is inclined by colliding of the end surface of the first pinion gear 35 and the ring gear 100 by Embodiment 1 of the present invention and the movement of the second pinion gear 34 to a direction opposite to the ring gear 100. In addition, FIG. 4 is a front view showing an example of the pinion gear unit in a state where the ring gear 100 is inserted to the first pinion gear 35 to be abutted to the second pinion gear 34 after the state of FIG. 3 by Embodiment 1 of the present invention. Further, FIG. 5 is a front view showing an example of the pinion gear unit in a state where the ring gear 100 is inserted to the first pinion gear 35 and the second pinion gear 34 to be engaged, after the states of FIGS. 3 and 4 by Embodiment 1 of the present invention.

Next, operations of Embodiment 1 will be described. In a case of performing engine starting, if a key switch (not shown) is turned on, current flows to the coil of the switch unit 40 and the plunger 50 is attracted. If the plunger 50 is attracted, the lever 60 is drawn to be rotated around a lever rotation shaft center 61.

If the lever 60 is rotated around the lever rotation shaft center 61, the end portion of the lever 60 on the side opposite to the plunger 50 pushes the pinion gear unit 30, and as a result, the pinion gear unit 30 is pushed to the direction of the ring gear 100 while being rotated, according to the helical spline formed on the output rotation shaft 20, and engaged with the ring gear 100 of the engine to rotate the ring gear 100, and thus, the engine is started. In addition, the same operation is also performed, in a case of performing an engagement operation in rotation of the engine.

In the engagement of the pinion gear and the ring gear, as shown in FIG. 3, when the first pinion gear 35 is not straightly inserted with respect to the ring gear 100 with a relationship of the phases, the first pinion gear 35 has backlash in the rotation direction and the radial direction, with respect to the cylindrical rotation member 32 rather than the second pinion gear 34, and the first pinion gear 35 is pushed to the ring gear 100 to be inclined, by the movement of the first and second pinion gears 35 and 34 to the direction of the ring gear 100 by the lever 60. Further, since a void 38 is provided on the abutting surface of the first pinion gear 35 and the second pinion gear 34, the first pinion gear is further inclined compared to a case with no void 38. At that time, the first pinion gear 35 is pushed to the ring gear 100 while the elastic body 33 is compressed through the second pinion gear 34.

In addition, by providing a gap 325 with a predetermined length between an outer periphery of a penetration portion of the cylindrical rotation member 32 which penetrates the first pinion gear 35 and an inner periphery of the penetration portion of the first pinion gear 35, so as to allow the inclination of the first pinion gear 35 over the entire area of the penetration portion in the circumferential direction, it is possible to provide a larger backlash on the first pinion gear 35 in the rotation direction and the radial direction, with respect to the cylindrical rotation member 32 rather than the second pinion gear 34.

Here, when the ring gear 100 or the motor unit 10 is rotated to be in a phase state where the first pinion gear 35 can be inserted to the next tooth of the ring gear 100, with a friction damper effect of the second pinion gear 34 and the cylindrical rotation member 32, in the operation in which the inclination the first pinion gear 35 is returning while being abutted to the ring gear 100, the first pinion gear 35 is not flicked with the ring gear 100 and inserted to the adjacent tooth of the ring gear 100, and as shown in FIG. 3, it is possible to synchronize the rotation by the abutting 350 of the tooth surfaces, and the insertion is performed as FIG. 4 described above. In addition, as the inclination of the first pinion gear 35 is large, the abutting of the tooth surfaces is expanded, the rotation is easily synchronized. Further, engagement is performed as FIG. 5 with the other pushing force.

As described above, the first pinion gear 35 and the second pinion gear 34 are configured on the tip portion of the pinion gear unit 30, and the void 38 is provided on the outer periphery end portion of the second pinion gear 34 on the abutting surface of the first pinion gear 35 and the second pinion gear 34, and thus, a movable range of the first pinion gear 35 is widened. Accordingly, when the second pinion gear 34 and the first pinion gear 35 are engaged with the ring gear 100, even in a case where a reason of the difference in the rotation speed of the ring gear 100, the second pinion gear 34, and the first pinion gear 35 is any one of the ring gear 100, and the first and second pinion gears 35 and 34, that is, even in a case where the rotation speed of the first and second pinion gears 35 and 34 is greater or smaller than the rotation speed of the ring gear 100, further reliable rotation synchronization and the phase focusing of the first and second pinion gears 35 and 34 and the ring gear 100 can be performed instantly at the time when the first and second pinion gears 35 and 34 are abutted to the ring gear 100.

In addition, a process of surface hardening of the first pinion gear 35 is performed using a ferrous material, and the surface hardness is set to satisfy ring gear<first pinion gear≤second pinion gear. As a result, other than abutting the pinion gear which has great inertia with high hardness as the pinion gear unit of the starter of the related art to the ring gear, the first pinion gear 35 which has low inertia with hardness equal to or less than the hardness of the second pinion gear 34 can be abutted to the ring gear 100, and it is possible to suppress abrasion of the ring gear 100 and the first pinion gear 35.

In addition, by setting an effective case depth of the first pinion gear 35 to satisfy effective case depth of the first pinion gear 35≤D/2, since abrasion resistance is improved and the entire first pinion gear is not hardened, even when the an impact load is applied to the first pinion gear 35, it is possible to prevent damage on the first pinion gear 35.

Further, by configuring the thickness of the first pinion gear 35 in a range to satisfy B−(A+C)<thickness D of first pinion gear 35<B−(A+C)/2, it is possible to prevent not returning of the pinion gear unit 30 by interference of the end surface of the first pinion gear 35 which is abutted to the ring gear 100 and an end surface on the side opposite thereto, on the end surface of the ring gear 100 which is abutted to the first pinion gear 35 and an end surface on the side opposite thereto, and sheet-rolled steel sheet can be punched and formed by setting the range described above.

As the result described above, it is possible to realize an engine starting device which suppresses noise, shortening of the life due to abrasion, delay of starting performance due to loss of the engagement time, without increasing the cost. In addition, the surface process may be a thermal process, and even when the other surface hardening process is performed, the same effect is obtained.

Embodiment 2

Figure 6:
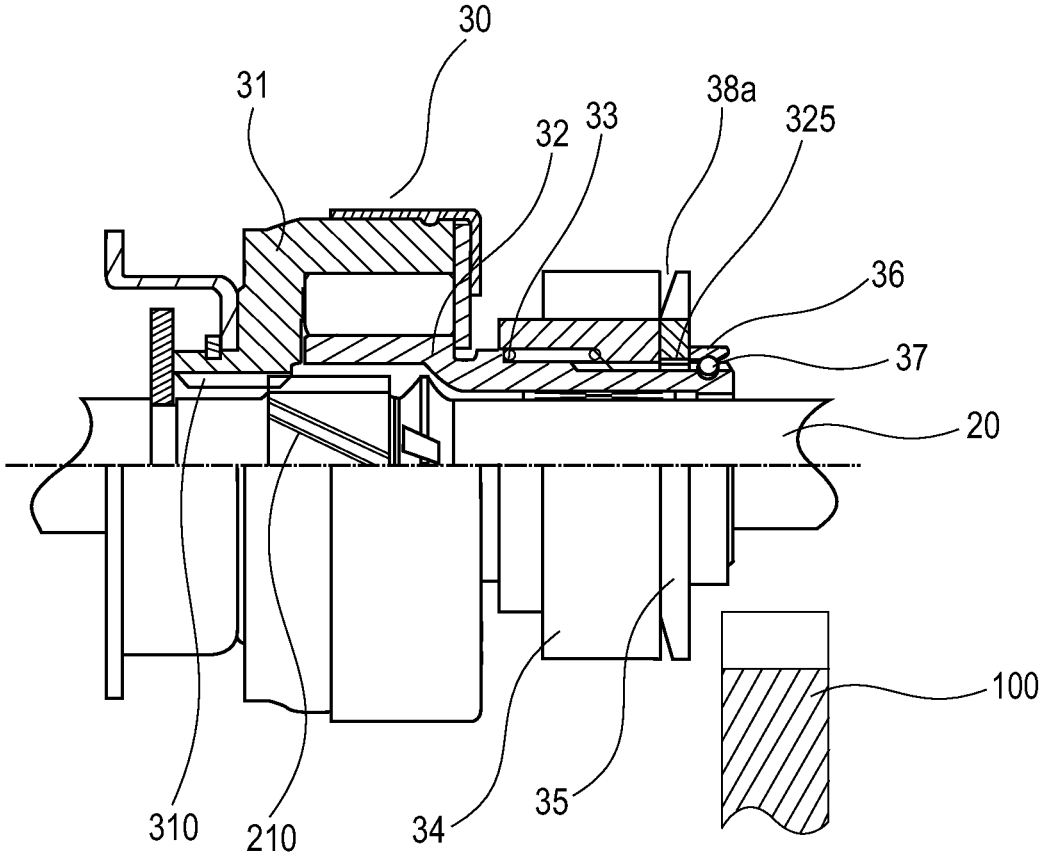
FIG. 6 is a view showing Embodiment 2 of the invention and is a front longitudinal sectional view partially showing another example of a pinion gear unit.

FIG. 6 is a cross-sectional view of components of the pinion gear unit 30 of Embodiment 2 of the present invention. The description of the same portions as Embodiment 1 will be omitted. In the abutting portion of the first pinion gear 35 and the second pinion gear 34, a void 38*a* is formed on the outer periphery end portion of the first pinion gear 35.

In Embodiment 2, an example of providing the void 38*a* on the outer periphery end portion of the first pinion gear 35 on the abutting surface of the first pinion gear 35 and the second pinion gear 34 is shown, however, since the movable range of the first pinion gear 35 is widened in the same manner as Embodiment 1, the same effect as Embodiment 1 is obtained.

Embodiment 3

Figure 7:
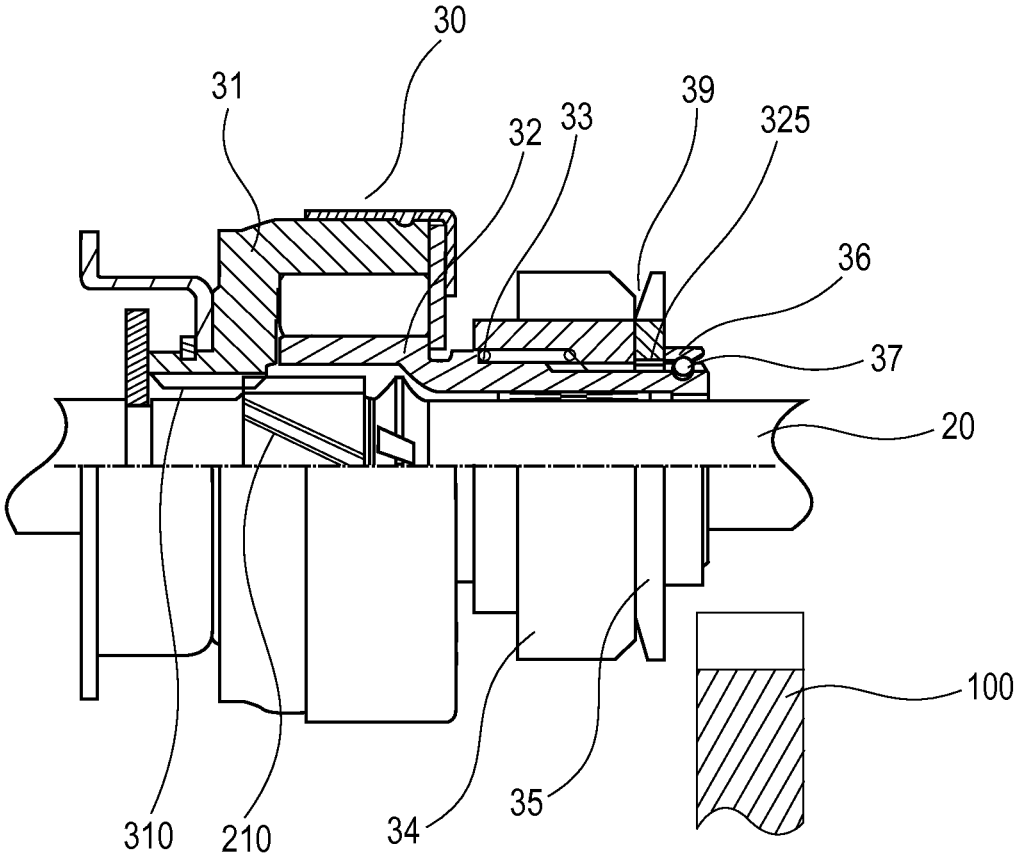
FIG. 7 is a view showing Embodiment 3 of the invention and is a front longitudinal sectional view partially showing still another example of a pinion gear unit.

FIG. 7 is a cross-sectional view of components of the pinion gear 30 of Embodiment 3 of the present invention. The description of the same portions as Embodiments 1 and 2 will be omitted. In the abutting portion of the first pinion gear 35 and the second pinion gear 34, a void 39 is formed on the outer periphery end portion of the first pinion gear 35 and the outer periphery end portion of the second pinion gear 34.

In Embodiment 3, an example of providing the void 39 on the outer periphery end portions of both the first pinion gear 35 and the second pinion gear 34 on the abutting surface of the first pinion gear 35 and the second pinion gear 34 is shown, however, since the movable range of the first pinion gear 35 is widened in the same manner as Embodiment 1, the same effect as Embodiment 1 is obtained.

Embodiment 4

Figure 8:
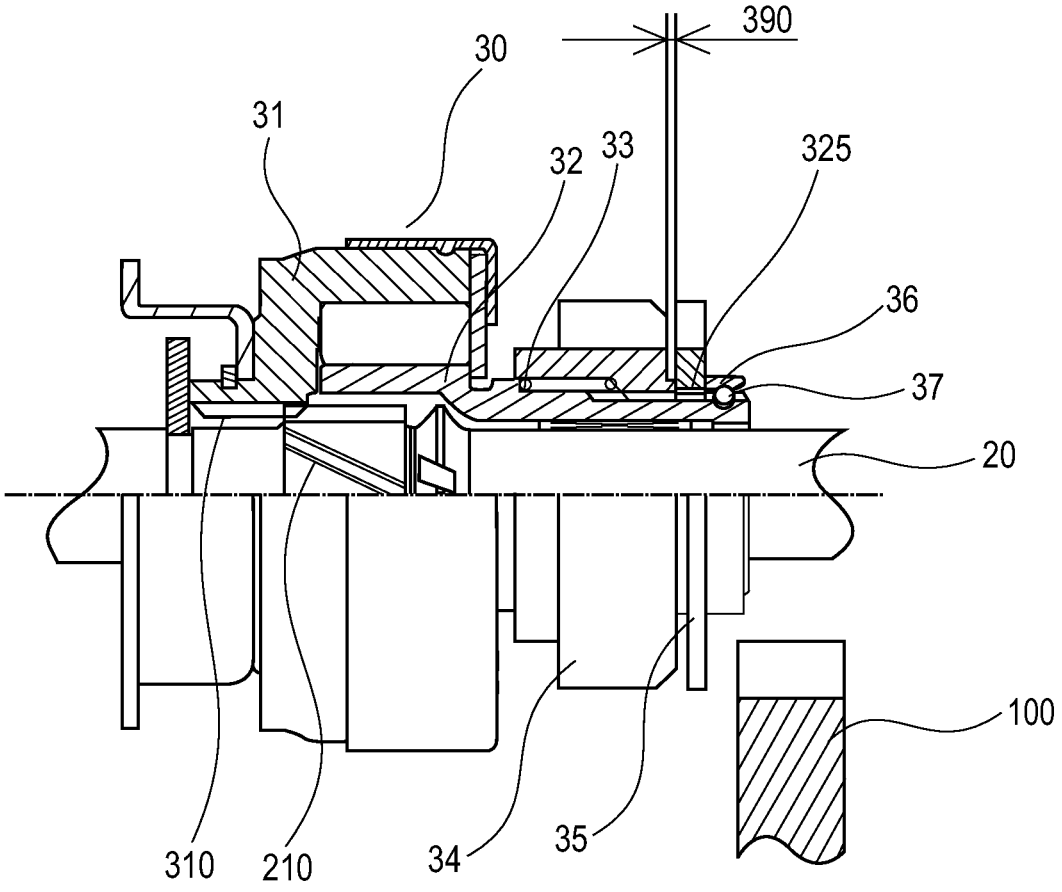
FIG. 8 is a view showing Embodiment 4 of the invention and is a front longitudinal sectional view partially showing still another example of a pinion gear unit.

FIG. 8 is a cross-sectional view of components of the pinion gear unit 30 of Embodiment 4 of the present invention. The description of the same portions as Embodiments 1, 2, and 3 will be omitted. The end surface portion of the first pinion gear 35 is configured to be separated by a predetermined distance 390 from the surface on the side of the end surface portion of the second pinion gear 34. Although the configuration as described above is used, since the inclination of the first pinion gear 35 is expanded as in the same manner as Embodiments 1 to 3, the same effect as Embodiments 1 to 3 is obtained.

In addition, the level difference for separating by a predetermined distance is provided on the second pinion gear side in FIG. 8, however, it may be provided on the first pinion gear side. Further, instead of the level difference, other members may be interposed between the end surface portion of the first pinion gear 35 and the end surface portion of the second pinion gear 34.

Figure 9:
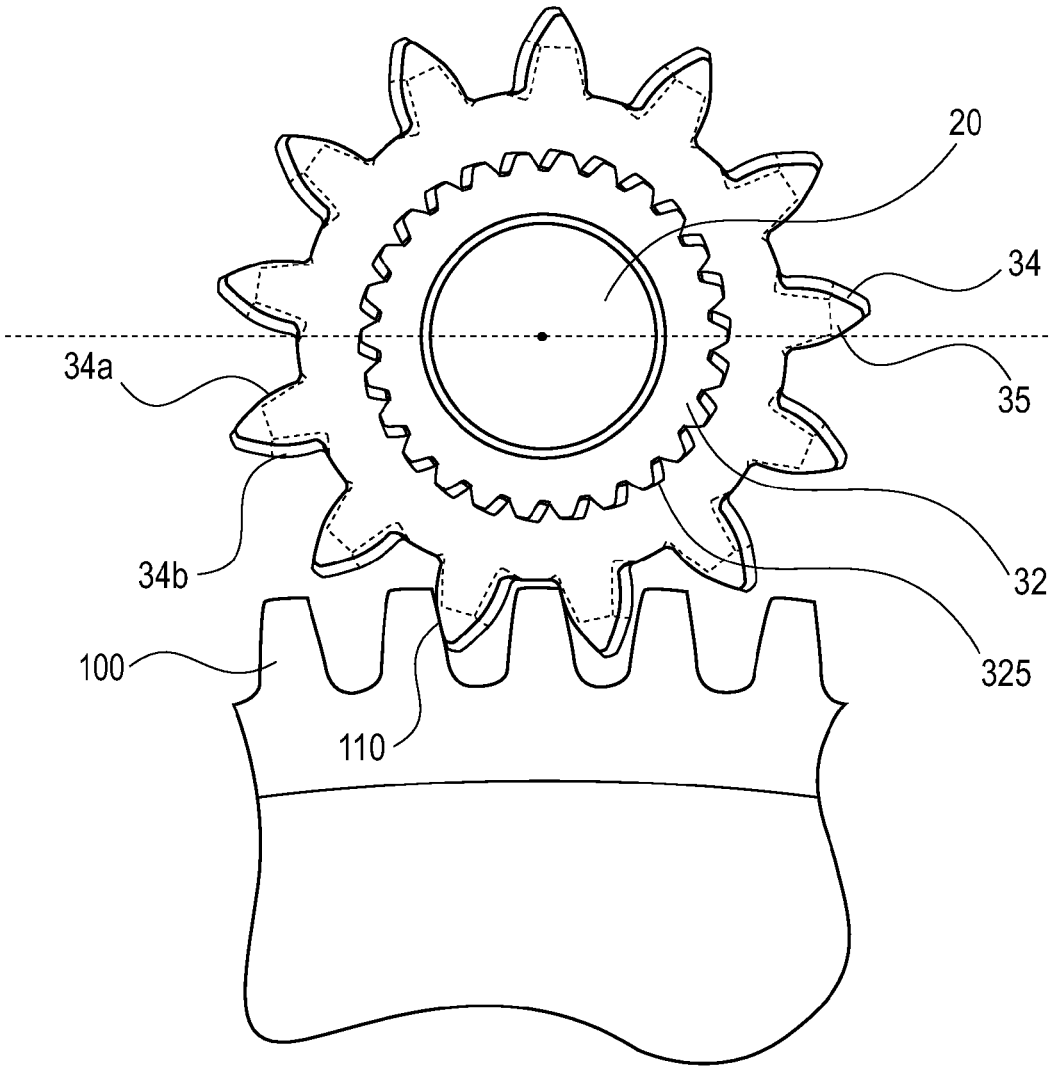
FIG. 9 is a view explaining the other effect of Embodiments 1, 3, and 4 of the invention, is a view showing an example of the engagement state of the pinion gear unit which is in a state where the first pinion gear is inserted to the ring gear to be abutted to the second pinion gear in a state of FIG. 4, and is a side view when seen FIG. 4 from the right side.
Figure 10:
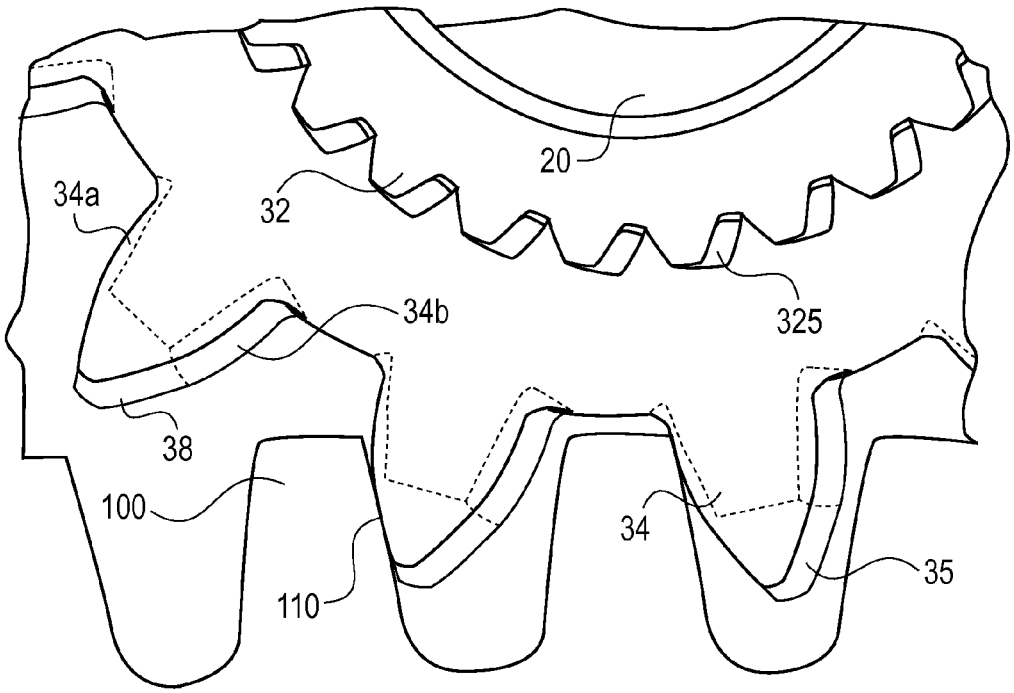
FIG. 10 is a view showing an interference portion of the view (FIG. 9) explaining the other effect of Embodiments 1, 3, and 4 of the invention, in detail.

In addition, FIGS. 9 and 10 are views seen the engagement state of Embodiment 1 as shown in FIG. 4, from the right side of FIG. 4. Herein, reference numerals 34*a* and 34*b* are chamfers of tooth surfaces of the second pinion gear 34. Herein, in an engaging process in a case where the rotation speed of the pinion gear is greater than the rotation speed of the engine starting gear, torque acts on the first pinion gear 35, and while deforming of the first pinion gear 35, the pinion gear unit 30 is moved in the axial direction from the state of FIG. 3 to the state of FIG. 4, and the engagement of the second pinion gear 34 and the ring gear 100 is started, however, in a case with no void 38, the second pinion gear 34 and the ring gear 100 interfere in the portion of 110 on the chamfer 34*a* side, and the engagement thereof is disturbed, in some cases.

In addition, by providing the gap 325 with a predetermined length on each tooth portion of the serration unit, between an outer periphery of a penetration portion of the cylindrical rotation member 32 which penetrates the second pinion gear 34 and the first pinion gear 35 through the serration unit as shown in the drawing and an inner periphery of the penetration portion of the first pinion gear 35, so as to allow the inclination of the first pinion gear 35 over the entire area of the penetration portion in the circumferential direction, the first pinion gear 35 can be moved in the rotation direction and the radial direction, with respect to the cylindrical rotation member 32 rather than the second pinion gear 34, and depending on the way of the movement of the first pinion and the dimensional precision thereof, the torque described above acts and the second pinion gear 34 and the ring gear 100 interfere to disturb the engagement thereof, in some cases, in the same manner as the case of the deformation of the first pinion.

In addition, in FIGS. 9 and 10, the engagement process of a case where the rotation speed of the pinion gear is greater than the rotation speed of the engine starting gear is shown, however, even in an engagement process of a case where the rotation speed of the engine starting gear is greater than the rotation speed of the pinion gear, the interference which is the same as described above is generated on the chamfer 34*b* side, and the engagement is disturbed, in some cases.

Herein, in Embodiments 1, 3, and 4, by forming the void 38 or the void 39 on the abutting surface of the first pinion 35 and the second pinion 34, it is possible to remove the interference portion 110. Accordingly, in the engagement state shown in FIGS. 9 and 10, in a case where the first pinion gear 35 is deformed and the engagement with the second pinion gear 34 is disturbed, an effect of preventing the excessive torque from acting on the first pinion gear 35 is realized. In addition, an effect of preventing generation of the disturbance of the engagement by interference of the second pinion gear 34 and the ring gear 100 depending on the way of the movement of the first pinion 35 and the dimensional precision thereof, is also obtained.

In addition, the same reference numerals in each drawing of FIGS. 1 to 10 denote the same or corresponding portions.

In addition, as clear in the above description and each drawing described above, the following technical features are provided in Embodiments of the invention.

Feature 1: In an engine starting device including: a motor unit 10; a pinion gear unit 30 which rotates according to the rotation of an output rotation shaft 20 driven by the motor unit 10; and a pushing mechanism 60 which moves the pinion gear unit 30 towards an engagement location of the pinion gears 34 and 35, and an engine starting gear 100, an engine is started by a rotation force of the motor unit 10 through the pinion gears 34 and 35, and the engine starting gear 100 which are engaged with each other, the pinion gear unit 30 includes a first pinion gear 35 which is initially engaged with the engine starting gear 100 if the pinion gear unit 30 is moved towards the engagement location by the pushing mechanism 60, and a second pinion gear 34 which is engaged with the engine starting gear later than the first pinion gear 35, in a state where the first pinion gear 35 is engaged with the engine starting gear 100, if the pinion gear unit further moves towards the engagement location by the pushing mechanism 60, to be adjacent to each other, at the time of the initial engagement of the first pinion gear 35 and the engine starting gear 100, in a case where the first pinion gear 35 collides with the engine starting gear 100, the first pinion gear 35 is inclined with respect to the second pinion gear 34, and a void 38 having a predetermined size is formed between a surface of an a end surface portion of the first pinion gear 35 on the side of an a end surface portion of the second pinion gear 34, and a surface of an a end surface portion of the second pinion gear 34 on the side of the a end surface portion of the first pinion gear 35, so as to expand the inclined state.

Feature 2: In the engine starting device according to Feature 1, the rotation member 32 which is commonly used for the first and second pinion gears 35 and 34 and rotates the first pinion gear 35 and the second pinion gear 34, penetrates the first and second pinion gears 35 and 34, to be spline-coupled with the first and second pinion gears 35 and 34, and a gap 325 for allowing the inclination between the first pinion gear 35 and the rotation member 32 is formed on the penetration portion.

Feature 3: In the engine starting device according to Feature 1 or 2, the void 38 is formed on at least one of a surface of a tooth portion of the first pinion gear 35 on a side of the tooth portion of the second pinion gear 34, and a surface of a tooth portion of the second pinion gear 34 on a side of the tooth portion of the first pinion gear 35.

Feature 4: In an engine starting device including: a motor unit 10, a pinion gear unit 30 which rotates according to the rotation of an output rotation shaft 20 driven by the motor unit 10; and a pushing mechanism 60 which moves the pinion gear unit 30 towards an engagement location of the pinion gears 34 and 35, and an engine starting gear 100, an engine is started by a rotation force of the motor unit 10 through the pinion gears 34 and 35, and the engine starting gear 100 which are engaged with each other, the pinion gear unit 30 includes a first pinion gear 35 which is initially engaged with the engine starting gear 100 if the pinion gear unit 30 is moved towards the engagement location by the pushing mechanism 60, and a second pinion gear 34 which is engaged with the engine starting gear 100 later than the first pinion gear 35, in a state where the first pinion gear 35 is engaged with the engine starting gear 100, if the pinion gear unit 30 further moves towards the engagement location by the pushing mechanism 60, to be adjacent to each other, at the time of the initial engagement of the first pinion gear 35 and the engine starting gear 100, in a case where the first pinion gear 35 collides with the engine starting gear 100, the first pinion gear 35 is inclined with respect to the second pinion gear 34, and a surface of an end surface portion of the first pinion gear 35 on the side of an end surface portion of the second pinion gear 34, and a surface of an end surface portion of the second pinion gear 34 on the side of the end surface portion of the first pinion gear 35 are separated by a predetermined distance 390 for further inclination of the inclined state.

Feature 5: In the engine starting device according to any one of Features 1 to 4, if the first pinion gear 35 is moved to collide with the engine starting gear 100, the second pinion gear 34 is moved to a direction separating from the engine starting gear 100, and the first pinion gear 35 is inclined, if the first pinion gear 35 is engaged with the engine starting gear 100 after the collision, the second pinion gear 34 is moved to a direction to be close to the engine starting gear 100, and by the movement of the second pinion gear 34 to the direction to be close to the engine starting gear 100, the first pinion gear 35 is pressed to the direction to be close to the engine starting gear 100 by the second pinion gear 34 and the first pinion gear 35 is returned from the inclined state to the state before the inclination.

Feature 6: In the engine starting device according to any one of Features 1 to 5, a tip portion of a tooth portion of the first pinion gear 35 in a radial direction does not come in contact with a tip portion of a tooth portion of the second pinion gear 34 in a radial direction, in the inclined state of the first pinion gear 35.

Feature 7: In the engine starting device according to any one of Features 1 to 6, if the first pinion gear 35 is moved to collide with the engine starting gear 100 to perform the inclination, while being pressed against the first pinion gear 35 and compressing an elastic body 33, the second pinion gear 34 is moved to a direction separating from the engine starting gear 100, and if the first pinion gear 35 is engaged with the engine starting gear 100 after the collision, the second pinion gear 34 is moved to a direction to be close to the engine starting gear 100 by a releasing force of the compressed elastic body 33.

Feature 8: In the engine starting device according to any one of Features 1 to 7, a thickness of the first pinion gear 35 in the direction of the engine starting gear 100 is thinner than a thickness of the second pinion gear 34 in the direction of the engine starting gear 100.

Feature 9: In the engine starting device according to any one of Features 1 to 7, the first pinion gear 35 has a function of performing rotation synchronization with the engine starting gear 100, and the second pinion gear 34 has a function of transmitting a rotation force of the second pinion gear 34 to the engine starting gear 100 by the engagement with the engine starting gear 100.

Feature 10: In the engine starting device according to any one of Features 1 to 9, the first pinion gear 35 is formed with a ferrous material.

Feature 11: In the engine starting device according to any one of Features 1 to 9, the first pinion gear 35 is formed by punching process of a steel sheet.

Feature 12: In the engine starting device according to Feature 11, the steel sheet is a sheet-rolled steel sheet.

Feature 13: In the engine starting device according to any one of Features 1 to 12, the first pinion gear 35 is formed with a ferrous material, and the surface thereof is subject to a hardening process.

Feature 14: In the engine starting device according to Feature 13, an effective case depth formed by the hardening process is half or less with respect to a thickness of the first pinion gear 35 in the axial direction.

Feature 15: In the engine starting device according to any one of Features 1 to 14, when surface hardness of the engine starting gear 100, the first pinion gear 35, and the second pinion gear 34 are set to be $H_R$, $H_{P1}$, and $H_{P2}$, respectively, $H_R<H_{P1}\leq H_{P2}$ is satisfied.

Feature 16: In the engine starting device according to any one of Features 1 to 15, when a facing gap between the first pinion gear 35 and an engine starting gear 100 at the time of rest of the engine starting device is set as A, a movement distance of the pinion gear unit 30 in the axial direction is set as B, a thickness of the engine starting gear 100 in the axial direction is set as C, and a thickness of the first pinion gear 35 in the axial direction is set as D, $B-(A+C)<D<B-(A+C)/2$ is satisfied.

Feature 17: In an engine starting device including a starter motor 10, a pushing mechanism 60 which moves the pinion unit 30 which is spline coupled with the output shaft 20 side of the starter motor 10 and slides in the axial direction to the engagement location with a ring gear 100, and a ring gear 100 which is engaged with pinions 34 and 35 of the pinion unit 30 pushed by the pushing mechanism 60 and starts an engine by transmitting a rotation force of the starter motor 10, the pinion unit 30 is in a protruded tooth shape for synchronization and is configured with a first pinion gear 35 which initially collides with the ring gear 100 at the time of starting engagement with the ring gear 100 and a second pinion gear 34 which performs a role of transmitting the rotation force after the engagement, and a void 38 is provided on the abutting surface of the first pinion gear 35 and the second pinion gear 34.

Feature 18: In an engine starting device including a motor unit 10, a pinion gear unit 30 which rotates according to rotation of an output rotation shaft 20 driven by the motor unit 10, and a pushing mechanism 60 which moves the pinion gear unit 30 towards an engagement location of pinion gears 35 and 34, and an engine starting gear 100, an engine is started by a rotation force of the motor unit 10 through the pinion gears 35 and 34, and the engine starting gear 100 which are engaged with each other, the pinion gear unit 30 includes a first pinion gear 35 which is initially engaged with the engine starting gear 100 if the pinion gear unit 30 is moved towards the engagement location by the pushing mechanism 60, and a second pinion gear 34 which is engaged with the engine starting gear later than the first pinion gear 35, in a state where the first pinion gear 35 is engaged with the engine starting gear 100, if the pinion gear unit 30 further moves towards the engagement location by the pushing mechanism 60, to be adjacent to each other, the tooth shape of the first pinion gear 35 is smaller than that of the second pinion gear 34, the first pinion gear 35 and the second pinion gear 34 are held on the rotation member 32 to be slide in the axial direction, and the first pinion gear 35 is held by providing a larger gap 325 than the second pinion gear 34 in a circumferential direction and a radial direction. At the time of the initial engagement of the first pinion gear 35 and the engine starting gear 100, in a case where the first pinion gear 35 collides with the engine starting gear 100, the first pinion gear 35 is inclined with respect to the second pinion gear 34, and a void 38 having a predetermined size is formed between a surface of an end surface portion of the first pinion gear 35 on the side of an end surface portion of the second pinion gear 34, and a surface of an end surface portion of the second pinion gear 34 on the side of the end surface portion of the first pinion gear 35, so as to expand the inclined state.

Feature 19: In a structure including a first pinion gear 35 which is initially engaged with the engine starting gear 100 if the pinion gear unit 30 is moved towards the engagement location by the pushing mechanism 60, and a second pinion gear 34 which is engaged with the engine starting gear 100 later than the first pinion gear 35, in a state where the first pinion gear 35 is engaged with the engine starting gear 100, if the pinion gear unit 30 further moves towards the engagement location by the pushing mechanism 60, to be adjacent to each other, the tooth shape of the first pinion gear 35 is smaller than that of the second pinion gear 34. In addition, since the first pinion gear 35 and the second pinion gear 34 are held on the rotation member 32 to be slide in the axial direction, and the first pinion gear 35 is held by providing a larger gap 325 than the second pinion gear 34 in a circumferential direction and a radial direction, an inserting property of the first pinion gear 35 is improved with a space generated with the smaller tooth shape and a space due to the gap 325 in the circumferential direction and the radial direction. In addition, since at the time of the initial engagement of the first pinion gear 35 and the engine starting gear 100, in a case where the first pinion gear 35 collides with the engine starting gear 100, the first pinion gear 35 is inclined with respect to the second pinion gear 34, and a void 38 having a predetermined size is formed between a surface of an end surface portion of the first pinion gear 35 on the side of an end surface portion of the second pinion gear 34, and a surface of an end surface portion of the second pinion gear 34 on the side of the end surface portion of the first pinion gear 35, so as to expand the inclined state, at the time of the engagement of the pinion gears 35 and 34, and the engine starting gear in the rotation of the engine starting gear 100 such as a ring gear, the inclination of the first pinion gear 35 is expanded and a region where a tooth surface of the engine starting gear is abutted to a tooth surface of the first pinion gear 35 is increased. Since an inserting property of the first pinion gear 35 is improved with a space generated with the small tooth shape and a space due to the gap 325 in the circumferential direction and the radial direction, and by having smaller inertia mass of the first pinion gear 35 than inertia mass of the second pinion gear 34, it is possible to obtain an engine starting device which further rapidly and further reliably performs rotation synchronization of the engine starting gear 100 and the pinion gears 35 and 34 and phase focusing of the teeth between the engine starting gear 100 and the pinion gears 35 and 34, at the time when the engine starting gear 100 is abutted to the pinion gear 35, and which can suppress the noise and shortening of the life due to the abrasion, in any cases of a case where the rotation speed of the engine starting gear 100 is greater than the rotation speed of the pinion gears 35 and 34, and a case where the rotation speed of the pinion gears 35 and 34 is greater than the rotation speed of the engine starting gear 100.

The invention claimed is:

1. An engine starting device comprising:

a motor unit;

an output rotation shaft driven by the motor unit;

a pinion gear unit which rotates according to the rotation of the output rotation shaft; and a pushing mechanism which moves the pinion gear unit towards an engagement location of the pinion gears, and an engine starting gear, wherein an engine is started by a rotation force of the motor unit through the pinion gears and the engine starting gear which are engaged with each other, the pinion gear unit includes a first pinion gear which is configured to engage with the engine starting gear when the pinion gear unit is moved towards the engagement location by the pushing mechanism, and a second pinion gear which is engaged with the engine starting gear after the first pinion gear, when the pinion gear unit further moves towards the engagement location, a void is formed between a surface of a tooth portion of the first pinion gear on the side of a tooth portion of the second pinion gear, and a surface of a tooth portion of the second pinion gear on the side of a tooth portion of the first pinion gear, a cylindrical rotation member which is penetrated by the output rotation shaft, and the cylindrical rotation member is commonly used for the first and second pinion gears and rotates the first pinion gear and the second pinion gear, penetrates the first and second pinion gears, to be fit to the first and second pinion gears, and a gap for allowing the inclination of the first pinion gear with respect to the second pinion gear is formed between the first pinion gear and the cylindrical rotation member on the penetration portion.

2. The engine starting device according to claim 1, wherein the void is formed on at least one of a surface of an end surface portion of the first pinion gear on the side of an end surface portion of the second pinion gear and a surface of an end surface portion of the second pinion gear on the side of the end surface portion of the first pinion gear.

3. The engine starting device according to claim 1, wherein, if the first pinion gear is moved to collide with the engine starting gear, the second pinion gear is moved to a direction away from the engine starting gear, and the first pinion gear is inclined, if the first pinion gear is engaged with the engine starting gear after the collision, the second pinion gear is moved in a direction toward the engine starting gear, and by the movement of the second pinion gear in the direction toward the engine starting gear, the first pinion gear is pressed in the direction toward the engine starting gear by the second pinion gear and the first pinion gear is returned from the inclined state to the state before the inclination.

4. The engine starting device according to claim 1, wherein a tip portion of an end surface portion of the first pinion gear in a radial direction does not come in contact with a tip portion of an end surface portion of the second pinion gear in a radial direction, in the inclined state of the first pinion gear.

5. The engine starting device according to claim 1, wherein, if the first pinion gear is moved to collide with the engine starting gear to perform the inclination while being pressed against the first pinion gear and compressing an elastic body the second pinion gear is moved to a direction separating from the engine starting gear, and if the first pinion gear is engaged with the engine starting gear after the collision, the second pinion gear is moved to a direction to be close to the engine starting gear by a releasing force of the compressed elastic body.

6. The engine starting device according to claim 1, wherein, a thickness of the first pinion gear in the direction of the engine starting gear is thinner than a thickness of the second pinion gear in the direction of the engine starting gear.

7. The engine starting device according to claim 1, wherein the first pinion gear has a function of performing rotation synchronization with the engine starting gear, and the second pinion gear has a function of transmitting a rotation force of the second pinion gear to the engine starting gear by the engagement with the engine starting gear.

8. The engine starting device according to claim 1, wherein the first pinion gear is formed with a ferrous material.

9. The engine starting device according to claim 1, wherein the first pinion gear is formed by punching process of a steel sheet.

10. The engine starting device according to claim 9, wherein the steel sheet is a sheet-rolled steel sheet.

11. The engine starting device according to claim 1, wherein the first pinion gear is formed with a ferrous material, and the surface thereof is subject to a hardening process.

12. The engine starting device according to claim 11, wherein an effective case depth formed by the hardening process is half or less with respect to a thickness of the first pinion gear in the axial direction.

13. The engine starting device according to claim 1, wherein, when surface hardness of the engine starting gear, the first pinion gear, and the second pinion gear are set to be $H_R$, $H_{P1}$, and $H_{P2}$, respectively, $H_R < H_{P1} \leq H_{P2}$ is satisfied.

14. The engine starting device according to claim 1, wherein, when a facing gap between the first pinion gear and an engine starting gear at the time of rest of the engine starting device is set as A, a movement distance of the pinion gear unit in the axial direction is set as B, a thickness of the engine starting gear in the axial direction is set as C, and a thickness of the first pinion gear in the axial direction is set as D, $B-(A+C) < D < B-(A+C)/2$ is satisfied.

* * * * *